US008313305B2

(12) United States Patent
Bevington

(10) Patent No.: US 8,313,305 B2
(45) Date of Patent: Nov. 20, 2012

(54) FLUID SYSTEM WITH PUMP ACTIVATION DEVICE

(75) Inventor: Jack T. Bevington, Ashland, OH (US)

(73) Assignee: Pentair Pump Group, Inc., Golden Valley, MN (US)

( * ) Notice: Subject to any disclaimer, the term of this patent is extended or adjusted under 35 U.S.C. 154(b) by 478 days.

(21) Appl. No.: 11/650,347

(22) Filed: Jan. 5, 2007

(65) Prior Publication Data

US 2008/0050246 A1 Feb. 28, 2008

Related U.S. Application Data

(60) Provisional application No. 60/840,285, filed on Aug. 25, 2006.

(51) Int. Cl.
*F04B 49/00* (2006.01)
*H01H 35/40* (2006.01)

(52) U.S. Cl. ..... 417/20; 417/43; 200/81.9 M

(58) Field of Classification Search ..... 417/20, 417/423.3, 297.5, 36, 39, 40, 43, 44.11; 137/101.25; 340/623, 625; 307/118; 200/81.9 R, 81.9 M
See application file for complete search history.

(56) References Cited

U.S. PATENT DOCUMENTS

| | | | | |
|---|---|---|---|---|
| 3,857,277 | A * | 12/1974 | Moore | 73/861.74 |
| 4,499,347 | A * | 2/1985 | Richards | 200/81.9 M |
| 4,746,270 | A | 5/1988 | Hale et al. | |
| 4,791,254 | A | 12/1988 | Polverari | |
| 5,225,641 | A | 7/1993 | Weld et al. | |
| 5,275,538 | A | 1/1994 | Paliwoda et al. | |
| 5,464,327 | A * | 11/1995 | Horwitz | 417/12 |
| 5,483,227 | A * | 1/1996 | Kuo et al. | 340/623 |
| 5,954,494 | A | 9/1999 | Goldsmith et al. | |
| 6,273,684 | B1 * | 8/2001 | Jensen et al. | 417/43 |
| 6,472,624 | B1 | 10/2002 | Harris et al. | |
| 6,752,590 | B2 | 6/2004 | Serio | |
| 2005/0158179 | A1 * | 7/2005 | Medizade et al. | 417/53 |

FOREIGN PATENT DOCUMENTS

| | | |
|---|---|---|
| MX | 150738 | 2/1987 |
| WO | WO 02/057632 A2 | 7/2002 |

OTHER PUBLICATIONS

"Flotec Series FP4815 Owner's Manual;" 2003; pp. 1-22; Delavan, WI.
"Waterace Owner's Manual;" Jan. 18, 2006; pp. 1-8; Ashland, OH.
"Booster Pumps Used to Boost Incoming City Pressure;" publication date and location unknown; pp. 7.

* cited by examiner

*Primary Examiner* — Peter J Bertheaud
(74) *Attorney, Agent, or Firm* — Quarles & Brady LLP

(57) ABSTRACT

The invention provides a fluid system with a pump activation device. The fluid system can include a tank containing fluid and a conduit connected to the tank for the distribution of fluid. The fluid system can include a pump apparatus that increases fluid pressure through the fluid system in response to a flow rate of fluid through the fluid system. The pump activation device can include a magnet that generates a magnetic field, causing the pump apparatus to increase the fluid pressure when the pump activation device is moved to an activation position.

14 Claims, 8 Drawing Sheets

FLUID SYSTEM WITH PUMP ACTIVATION DEVICE

RELATED APPLICATION

This application claims the benefit of Provisional U.S. patent application Ser. No. 60/840,285, filed Aug. 25, 2006, the entire disclosure of which is incorporated herein by reference.

FIELD OF THE INVENTION

The invention relates generally to liquid fluid systems having pumps, and more particularly, to a pump apparatus that boosts pressure of the fluid through a conduit and to valve outlets of the fluid system.

BACKGROUND

In gravity-fed or low pressure fluid systems, the pressure of fluid flowing through conduits and through various outlet valves of the fluid system may be inadequate to maintain the desired flow rate of fluid at a given outlet valve. For example, in a residential application, gravity-fed water may be suitable for many outlet uses, such as kitchen or bathroom sink faucets. However, in some cases, the gravity-fed water pressure may be too low to adequately supply water to showers or toilets, for example.

In some cases, fluid systems can include a pump apparatus having a motor that drives the pump continuously, whether at a fixed or variable speed, to ensure adequate pressure and flow rate are maintained. However, in other cases, a continuous boost in pressure is undesirable.

SUMMARY

Accordingly, there is a need for a fluid system that provides for pressurized fluid in some instances, yet can maintain the pressure of gravity at times when the pressure of gravity suffices for supply of fluid at a particular downstream valve outlet.

In one embodiment, the invention provides a fluid system including a tank containing fluid and a conduit connected to the tank for the distribution of fluid. The fluid system can include a pump apparatus that can increase fluid pressure through the fluid system in response to a flow rate of fluid through the fluid system. The pump apparatus can include an activation device with a magnet that generates a magnetic field. The magnetic field can cause the pump apparatus to increase the fluid pressure when the activation device is moved to an activation position.

In another embodiment, the invention provides a pump apparatus including a pump that increases the pressure of fluid in communication with the pump apparatus, a motor that operates the pump, and an activation device. The activation device can be movable to and from an activation position at which the motor and the pump are activated in response to a flow rate of fluid in communication with the pump apparatus.

In yet another embodiment, the invention provides an activation assembly for a fluid delivery system. The activation assembly can include an activation device having a magnet and a proximity switch that turns on and off depending upon the relative location of the magnet.

In some embodiments, the invention provides a method of delivering fluid. Fluid flows through a pump apparatus by a force of gravity. An activation device positioned in the pump apparatus can move with the flowing fluid toward and away from a proximity switch. A pump can be turned on when the activation device is sufficiently close to the proximity switch. The pressure of the flowing fluid can be increased with the pump.

BRIEF DESCRIPTION OF THE DRAWINGS

The various embodiments of the invention can be understood with reference to the following drawings. The components in the drawings are not necessarily to scale. Also, in the drawings, like reference numerals designate corresponding parts throughout the several views.

DESCRIPTION

Figure 1:
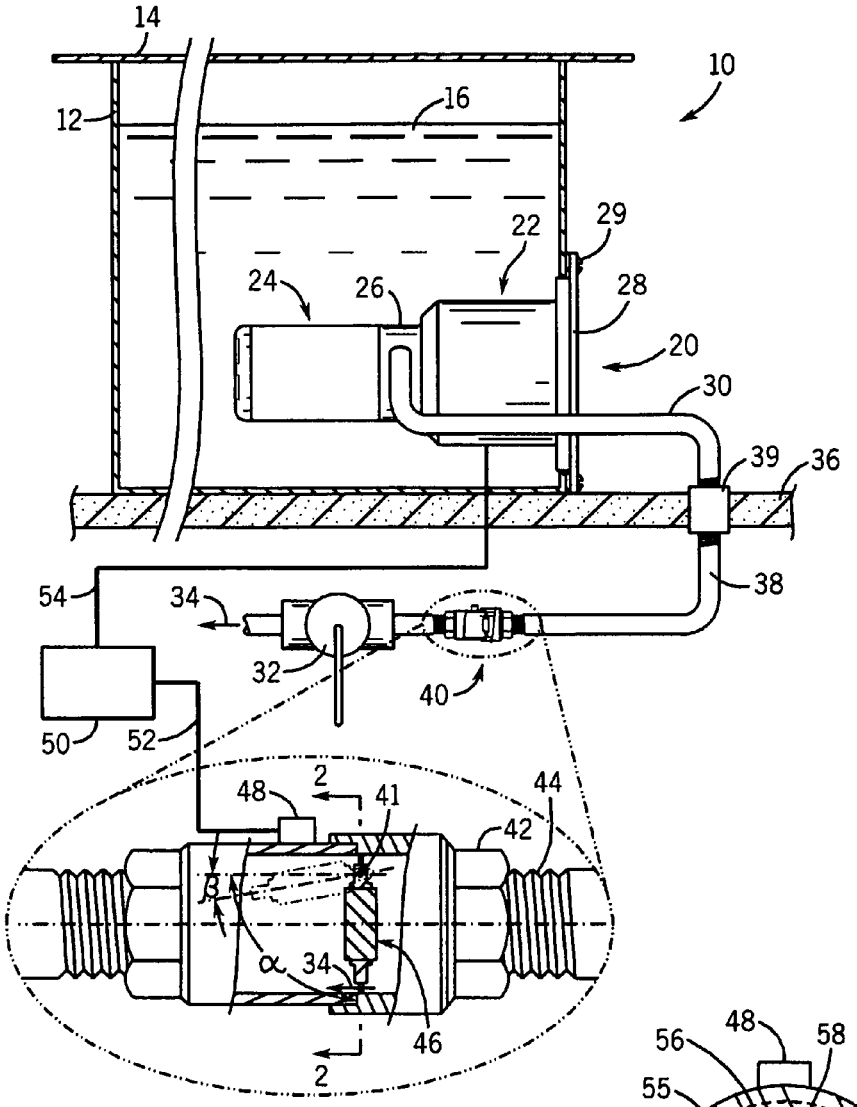
FIG. 1 is a schematic illustration of a fluid system showing a tank containing fluid, a conduit for delivery of fluid downstream, and the components of a pump apparatus, according to an embodiment of the invention.

FIG. 1 illustrates a fluid delivery system 10 according to one embodiment of the invention. The fluid delivery system 10 can include a fluid tank 12 with an optional cover 14. The tank 12 contains fluid 16 which flows from inside the tank 12 to one or more fluid destinations external to the tank 12. Fluid system 10 can include a pump apparatus 20 that pressurizes fluid based on the flow rate of the fluid 16. The pump apparatus 20 can include a pump 22, and a motor 24 that operates the pump 22, in order to drive an impeller (not shown) of the pump 22. The pump 22 and the motor 24 can be housed in the same housing 26 or in separate housings. The housing 26 of the pump 22 and the motor 24 can be mounted to the tank 12 by a mounting plate 28 that is fastened to the tank 12 with fasteners 29. The fasteners 29 can be screws or other suitable fasteners. The pump 22 can be submerged or positioned inside the tank 12 as shown, but can also be located external to the tank 12.

The tank 12, as shown, is located at an elevated position relative to the destination of the fluid 16 at the various fluid outlets. Fluid 16 can be gravity-fed through a conduit 30 to one or more downstream valves, for example, through a valve 32 in a direction of flow indicated by an arrow 34. In a residential application, for example, the tank 12 can be mounted on the roof 36 of a house so that the fluid 16 is able to flow by gravity through the conduit 30 above the roof 36 and through a conduit 38 below the roof 36. The conduit 30 and the conduit 38 can be joined by a coupling 39. The fluid 16 can flow to various plumbing fixtures, such as a sink, a toilet, and a shower, for example, inside of the house. The flow of fluid due to gravity may be sufficient to dispense fluid for many uses at various destinations (e.g., sinks). However, in some cases, additional fluid pressure or "fluid velocity" is needed (e.g., showers).

A pump activation assembly 40 can be positioned downstream from the tank 12 and the pump 22 and upstream from the valve 32. The pump activation assembly 40 can control the motor 24 and the pump 22. The pump activation assembly 40 can control whether the pump 22 is turned on to pressurize fluid flowing through the conduits 30 and 38 toward the valve 32, or whether the motor 24 and/or the pump 22 are off, allowing a gravity feed of fluid through the conduits 30 and 38. FIG. 1 illustrates an enlarged cutaway view (dotted portion) of the pump activation assembly 40 of the fluid delivery system 10. The pump activation assembly 40 can include an activation device 46 which can be movable toward and away from a proximity switch 48. As shown, the activation device 46 can be positioned in a coupling 42, for example, a pipe nipple or one or more pipe connectors, threaded onto pipe threads 44 of the conduit 38. The activation device 46 and the coupling 42 can be positioned inside a house. However, the activation device 46 can also be positioned above a roof, outside the house, within the conduit 30, and either internal or external to the tank 12.

In some embodiments, the motor 24 of the pump apparatus 20 can include or be connected to a motor switch 50. The motor switch 50 can be electrically connected to the proximity switch 48 via a conductor 52 and can also be electrically connected to the motor 24 via a conductor 54. When the activation device 48 is moved close enough to the proximity switch 48 to close the proximity switch 48, an electrical connection is made to the motor switch 50 which turns on the motor 24. The motor 24 drives the impeller of the pump 22 and additional fluid pressure is created within the conduits 30 and 38 so that fluid flow through the valve 32 has increased fluid velocity. The type of motor 24 and the power rating of the motor 24 can vary. For example, the horsepower (hp) of the motor 24 can range from about 0.05 hp to about 10 hp, from about 0.5 hp to about 8 hp, and from about 0.1 hp to about 5 hp, etc.

Figure 2:
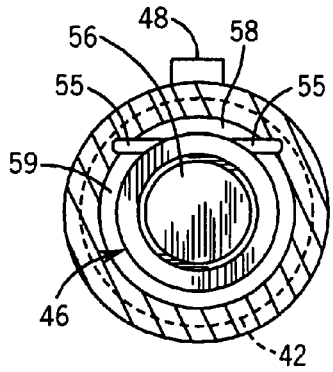
FIG. 2 is a cross-sectional view of the conduit and an activation device taken along lines 2-2 of the fluid system of FIG. 1, according to one embodiment of the invention.

FIG. 2 illustrates a cross-section of the activation device 46 of FIG. 1. The activation device 46 can include a magnet 56 and, in some embodiments, a housing 58 that at least partially surrounds the magnet 56. The activation device 46 can also include a pin 55 protruding from the magnet housing 58 and that is connected, anchored to, or supported by the coupling 42. FIG. 2 illustrates that there can be a clearance 59 between the activation device 46 and the coupling 42 so that fluid can flow around the activation device 46 even when the activation device 46 is extended substantially transverse or perpendicular to the fluid flow (as indicated by arrow 34). The clearance 59 for fluid flow, as shown, can be an annular opening. However, the clearance 59 for fluid flow can be any suitable shape defined by the activation device 46 within the coupling 42 and can depend upon one or both of their respective geometric shapes.

The activation assembly 40 of the pump apparatus 20 can operate as follows. Fluid flow through fluid delivery system 10 can be initiated by opening the valve 32, which can be located at a remote location for dispensing fluid, for example, a sink, toilet or shower. The magnet 56 (as shown in FIG. 2) of the activation device 46 can create a magnetic field which, when moved close enough to the proximity switch 48, can close the proximity switch 48 to turn the motor 24 and the pump 22 on. The activation device 46 can rotate about an axis 41 along an angle of rotation, angle alpha. The angle of rotation alpha can be relatively large, for example, any suitable angle less than about 360 degrees. The activation device 46 can rotate freely depending upon the location of the axis 41 and the extent to which the activation device 46 is constrained within the coupling 42.

In some embodiments, the activation device 46 can extend from a vertical position that is substantially perpendicular to the flow of fluid (as indicated by arrow 34) to a position that is substantially parallel to the flow of fluid, in which case the angle alpha is approximately 90 degrees. Depending upon the flow rate of fluid causing the activation device 46 to rotate, the activation device 46 reaches an activation position at which the magnetic field created by the magnet 56 causes the proximity switch 48 to close. The activation device 46 can be rotated at some angle of rotation less than angle alpha, for example angle alpha minus angle beta, at which the activation device 46 is in the activation position. The activation position can depend upon several factors, including but not limited to, the type and/or strength of the magnet 56, the type of proximity switch 48, the weight of the activation device 46, and the tension between the activation device 46 and the axis 41 about its pivot point, for example. The activation position need not be a single position and can be a full range of positions within the sweep of angle beta, for example, as the activation device 46 sweeps from a vertical position toward a horizontal position in the direction of fluid flow.

The activation position can be set or predetermined based upon the fluid flow rate or the fluid velocity demanded by the fluid delivery system 10. For example, when the valve 32 is closed and the flow rate of the fluid is zero, the activation device 46 can be spaced a distance from the proximity switch 48, the proximity switch 48 can be open, and the motor 24 and the pump 22 can be off. When the valve 32 is opened, the fluid pushes against the activation device 46. Depending upon the extent to which the valve 32 is opened, the velocity head of the fluid can cause the activation device 46 to rotate or pivot about the axis 41, which may or may not cause the activation device 46 to reach the activation position. The fluid 16 may push the activation device 46 toward the proximity switch 48, or may flow around the activation device 46 through the annular clearance 59 (as shown in FIG. 2). If the downstream valve, for example valve 32, is opened far enough so that the fluid velocity forces the activation device 46 to reach the activation position, the magnetic field can cause the proximity switch 48 to close, which can gate or close the motor switch 50 in order to turn on the motor 24 and the pump 22.

When the proximity switch 46 reaches the activation position and is oriented at an angle beta, relative to the direction of fluid flow, the proximity switch 48 can close and the motor switch 50 can be turned on to operate the motor 24 and the pump 22. For example, the activation device 46 can be oriented along an angle, such as less than about 90 degrees, less than about 60 degrees, less than about 30 degrees, etc., relative to the direction of flow. When the proximity switch 48 closes, the pump 22 can pressurize the fluid 16 within the fluid delivery system 10 to increase the flow rate or flow velocity of the fluid through the conduits 30 and 38. When the demand for fluid downstream is decreased, for example, by partially or completely closing the valve 32, the activation device 46 can rotate away from the activation position toward its vertical resting position. The magnet 56 can fall to a resting position due to its weight and gravity, causing the magnet 56 to move away from the proximity switch 48. The magnetic field created by the activation device 46 is no longer strong enough to cause the proximity switch 48 to be maintained in a closed position. The proximity switch 48 can open and electrical current to the motor switch 50 can cease in order to turn the motor 24 and the pump 22 off.

The activation position can be predetermined so that the activation device 46 reaches the activation position when the flow rate of the fluid is, for example, at least about one liter per minute, at least about two liters per minute, at least about three liters per minute, at least about ten liters per minute, etc. For example, the activation position can be predetermined so that the activation device 46 reaches the activation position when the flow rate ranges from about one liter per minute to about ten liters per minute. The flow rate of the fluid can be controlled by the size of the orifice or opening within the valve 32, or the degree to which the valve 32 is opened. Thus, smaller valve openings can be chosen for fluid destinations that require a relatively low flow rate (e.g., a sink), whereas larger valve openings can be chosen for fluid destinations that require a relatively high flow rate (e.g., showers or toilets). The weight of the magnet 56 and housing 58 in FIGS. 1 and 2, or the force required to pivot the housing of FIG. 1, as well as the positioning of the magnet 56 and the housing 58, can be adjusted so that a predetermined flow rate is required to move the magnet 56 enough to create a magnetic field that closes the proximity switch 48.

In one embodiment, the proximity switch 48 can include a reed switch. The proximity switch 48 can operate with a current that ranges from about 0.1 milliamps to about ten milliamps, from about one milliamp to about eight milliamps, from about three to about five milliamps, etc. The magnet 56 of the activation device 46 can create a magnetic field that causes the conductors within the proximity switch 48 to close to complete the circuit. When the circuit within the proximity switch 48 is closed, it sends a current to the motor switch 50 which then turns on the motor 24. In some embodiments, the motor switch 50 can be a triac switch, a solid state switch, a relay, etc. The motor switch 50 can operate with a higher current than the proximity switch 48, and can operate with a current that ranges, for example, from about 0.1 amps to about fifty amps, from about 0.5 amps to about twenty amps, from about 0.5 amps to about ten amps, etc.

Figure 3:
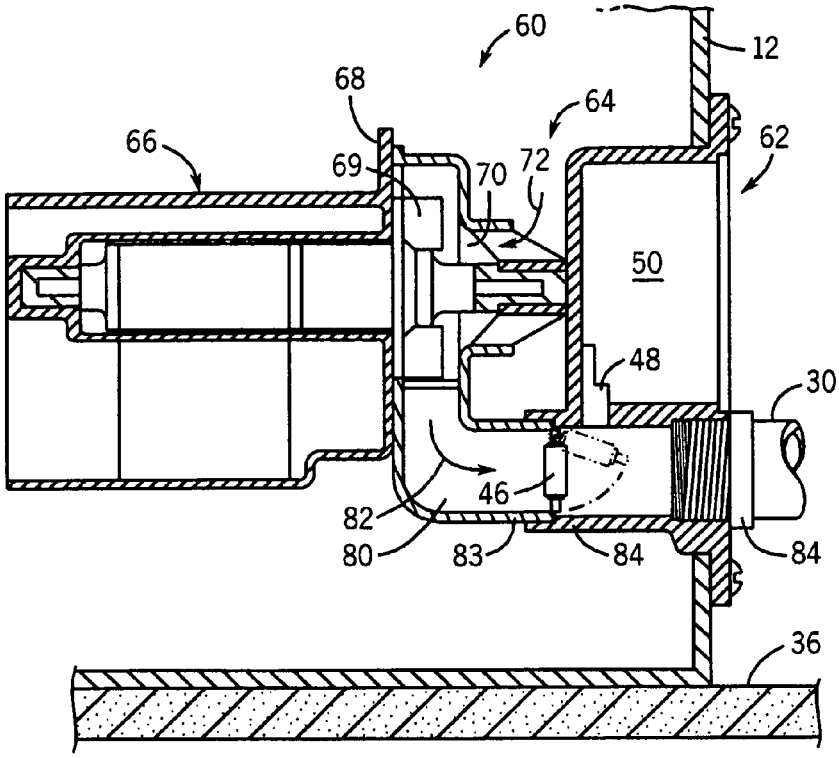
FIG. 3 is a partial cross-sectional view of a fluid system, including an activation device, according to another embodiment of the invention.

FIG. 3 is an illustration of a fluid system 60, according to another embodiment of the invention, having a pump apparatus 62. The pump apparatus 62 can include a pump 64 and a motor 66 positioned within a tank 12 of the fluid system 60. An activation device 46 can be positioned inside a pump housing 68. The fluid can flow through channels 70, 80 of the pump 64 in directions 72 and 82, respectively, and can contact the activation device 46, which can be positioned within the channel 80 where fluid exits the tank 12. The pump 66 can pump fluid from the tank 12 through the conduit 30, which can be attached to the pump housing 68 via a coupling 84, and can be positioned downstream from one or more valves (not shown).

Figure 3A:
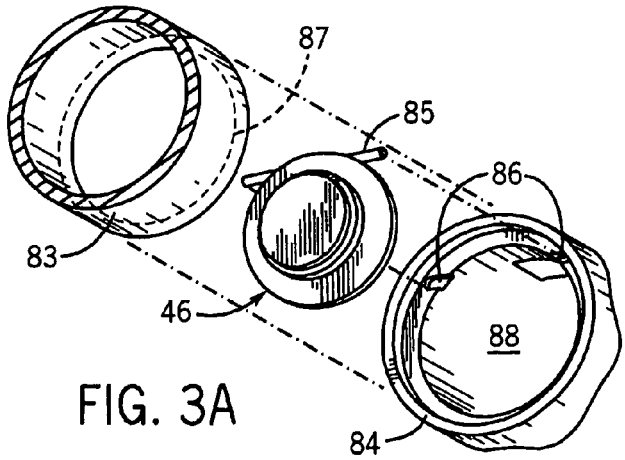
FIG. 3A is an enlarged perspective view of the activation device of FIG. 3.

FIG. 3A illustrates the activation device 46 being mounted and free to rotate. The activation device 46 can be supported between a first portion 83 and second portion 84 of the pump 64. The activation device 46 can include a hinge 85 which can rest on arms 86 of the second portion 84 of the pump 64. An end surface 87 of the first portion 83 can make contact with a recess 88 of the second portion 84 to secure the hinge 85. During operation, the activation device 46 can be free to rotate, for example, in the direction of fluid flow indicated by the arrow 82 (as shown in FIG. 3).

Figure 4:
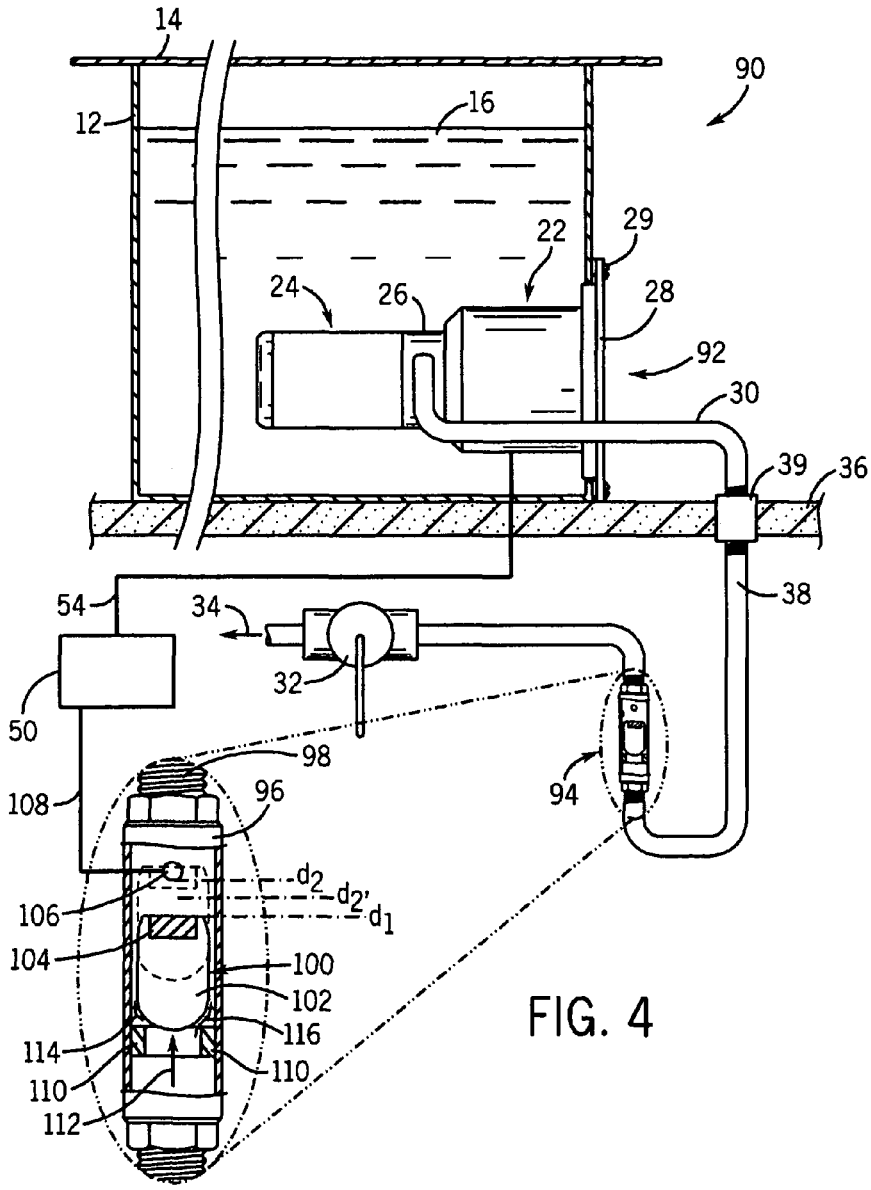
FIG. 4 is a schematic illustration of a fluid system and activation device according to another embodiment of the invention.

FIG. 4 illustrates a fluid delivery system 90 according to another embodiment of the invention. The fluid delivery system 90 can include a pump activation system 92 having a pump 22 and a motor 24, both contained within a housing 26 and positioned in the tank 12. The fluid 16 within the tank 12 can be gravity fed through the conduits 30 and 38, coupled to one another by the coupling 39, to the downstream valve 32 with the fluid flow in the direction indicated by the arrow 34. The pump activation system 92 can pump the fluid 16 through the conduits 30 and 38 when an activation assembly 94 causes the motor 24 and the pump 22 to turn on.

The activation assembly 94 can be located in a vertical section of the conduit 38. An expanded view (dotted lines) illustrates the activation assembly 94 positioned within a coupling 96 connected by threads 98 of the conduit 38. The activation assembly 94 can include an activation device 100 with a magnet 104 in a housing 102. The activation device 100 can move in a substantially axial direction (with the flow of fluid indicated by an arrow 112) through the coupling 96. The magnet 104 can be located at $d_1$ and can be movable in a substantially linear direction to a terminating position $d_2$ (in phantom in FIG. 4) at which point it can contact a proximity switch 106. As shown in FIG. 4, the magnet 104 of the activation device 100 can be slightly buoyed by the fluid 16 at a position above stops 110 with the fluid being able to move around the activation device 100 in directions indicated by arrows 114 and 116. When the valve 32, for example, is opened enough to cause a large pressure drop, the activation device 100 can be forced upward to position $d_2'$ (i.e., an activation position), which can be located at a suitable distance above the resting position of the activation device 100 when seated on stop 110. For example, when the magnet 104 of activation device 100 is located at position $d_1$, the activation device 100 may or may not be in the activation position.

The movement of the activation device 100 by a predetermined flow rate can cause the proximity switch 100 to close in the activated position. When the proximity switch 100 closes, an electrical signal is sent to the motor switch 50 via a conductor 108 to turn on the motor 24 and the pump 22 via another conductor 54. The distance the activation device 100 travels upward to reach an activation position depends upon many factors, such as the strength of the magnetic field caused by magnet 104, the type of proximity switch 106, and the weight of the activation device 100. The proximity switch 106 is shown extending transverse across the diameter of the coupling 96 and can be used as a stop. However, the proximity switch 106 can be positioned along an inside surface of the coupling 96 or can be located external to the coupling 96.

The magnet 104 can be at least partially surrounded by a housing 102 of the activation device 100. The magnet 104 can be fully enclosed by the housing 102, as long as the wall thickness of the housing 102 allows transmission of magnetic waves. The housing 102 can be constructed of many different types of materials, for example, a polymeric material, such as thermoset and/or thermoplastic materials.

There are many alternative arrangements in which the activation device 100 can move between an activated position and an inactivated position relative to the proximity switch 106 and depending upon the fluid flow. For example, in another embodiment, the activation assembly 94 can include a spring attached to the activation device 100 on one end and directly or indirectly anchored to the coupling 96. When the flow rate is great enough to either elongate or compress the spring, the magnet 104, and/or the housing 102, can move in a horizontal or vertical position to create a magnetic field with the proximity switch 106. The spring can be selected with a predetermined spring constant that can cause the activation device 100 to close the proximity switch 106 at a desired or predetermined flow rate of fluid 16 through the fluid delivery system 90.

Figure 5:
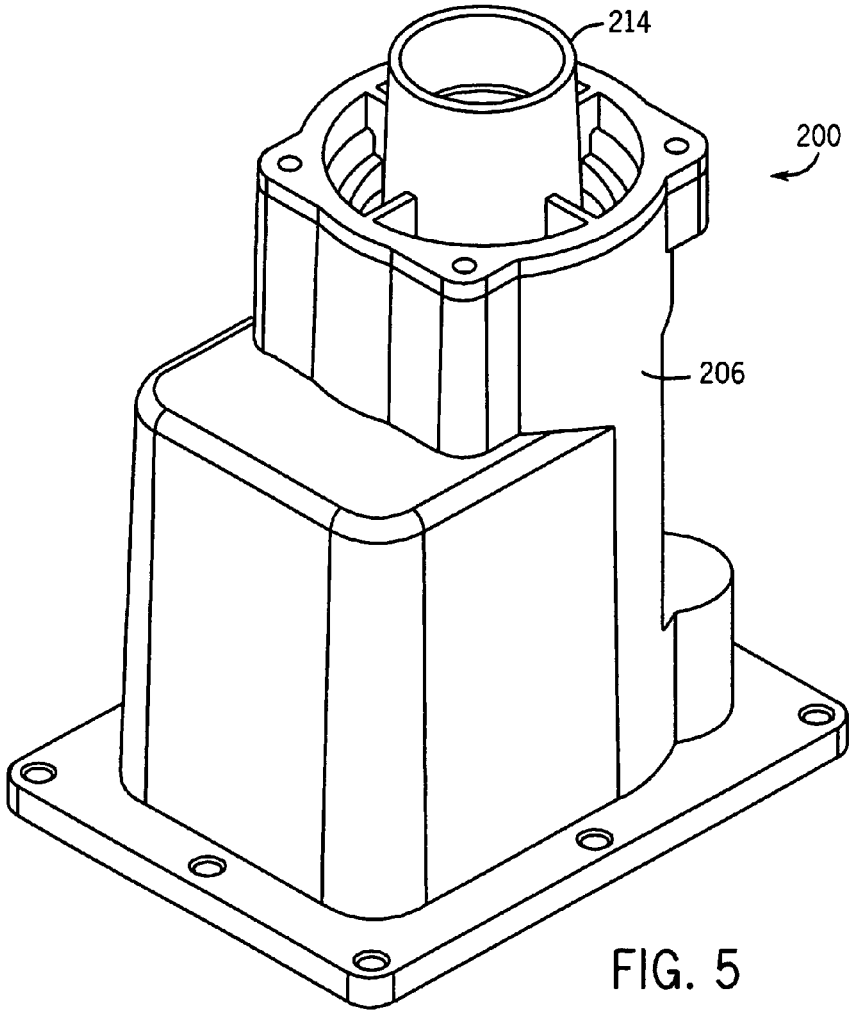
FIG. 5 is a perspective view of an alternative fluid system and activation device, according to another embodiment of the invention.
Figure 6:
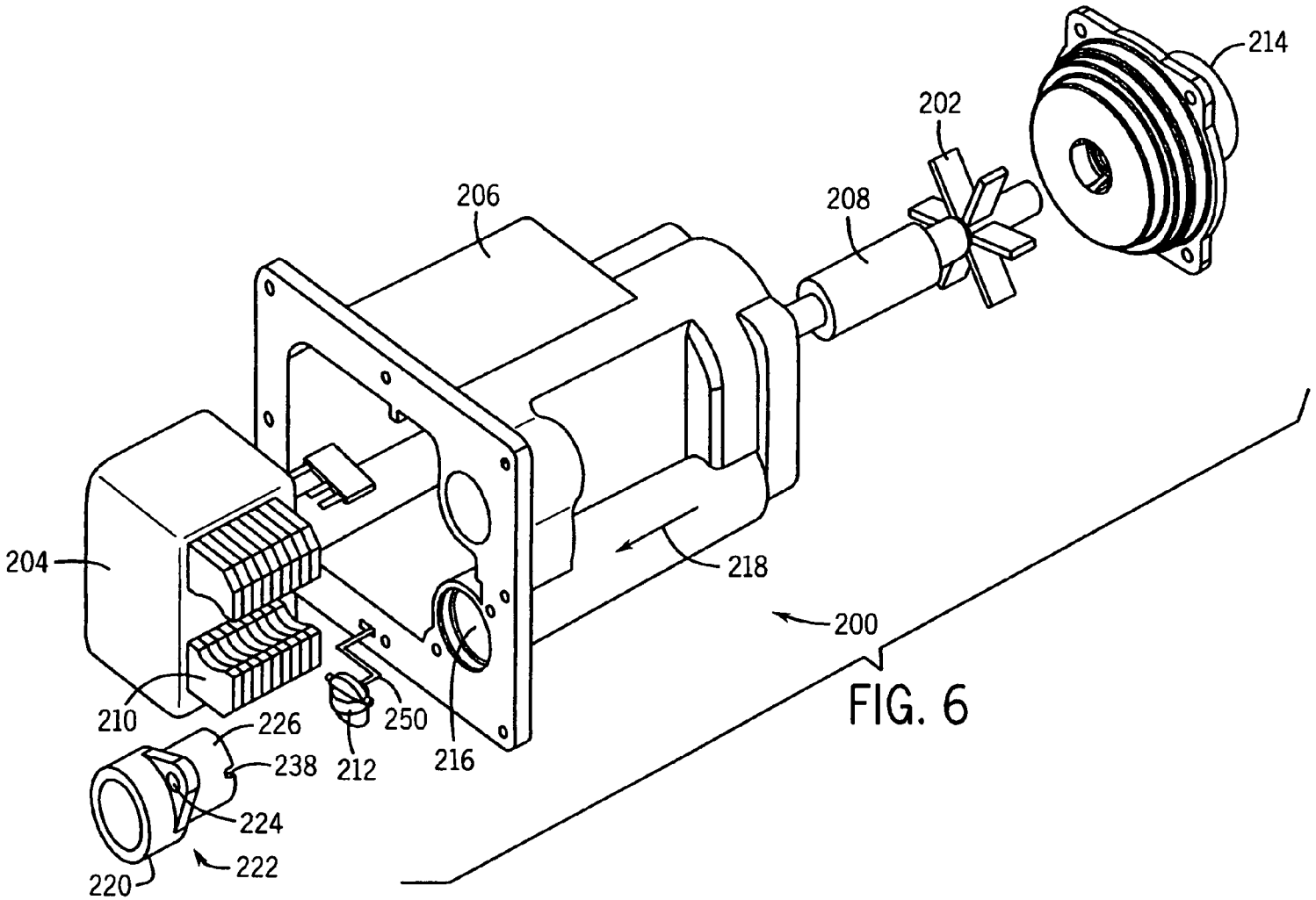
FIG. 6 is an exploded perspective view of the fluid system and activation device of FIG. 5.
Figure 7:
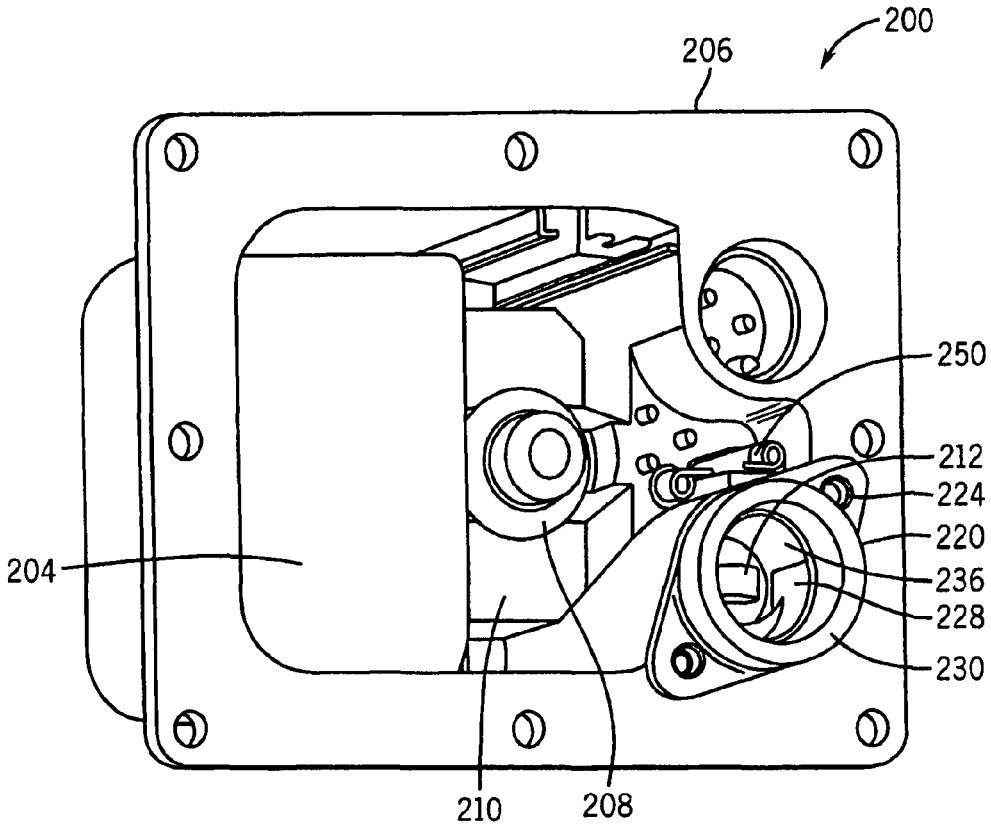
FIG. 7 is a bottom view of the fluid system and activation device of FIG. 5.

FIGS. 5 and 7 are illustrations of a pump apparatus 200 according to an alternative embodiment of the invention. FIG. 6 is an exploded view of the pump apparatus 200. The pump apparatus 200 can include a pump 202 driven by a motor 204 positioned within a pump and a motor housing 206. The motor 204 can include a rotor 208 and a stator 210. An activation assembly 212 can be positioned inside the pump and motor housing 206. Fluid can flow from a source, such as a tank (not shown), into the pump apparatus 200 through a coupling 214 and into a channel 216 of the pump and motor housing 206 in the direction indicated by an arrow 218. Fluid can contact the activation assembly 212, which can be positioned within the channel 216, and fluid can exit the housing 206 through a coupling 220. The coupling 220 can be connected to a conduit leading to a valve that controls fluid flow to an outlet destination (not shown). The pump 202, when powered by the motor 204, pressurizes the fluid flowing through the channel 216.

An activation assembly housing 222 can be position in the channel 216 and can include a flange 224 for securing the activation assembly housing 222 to the pump and motor housing 206. The activation assembly housing 222 can include a first portion 226 forming a channel 228, as shown in FIG. 7, which can be inside the channel 216, and a second portion 230 forming the coupling 220.

Figure 8:
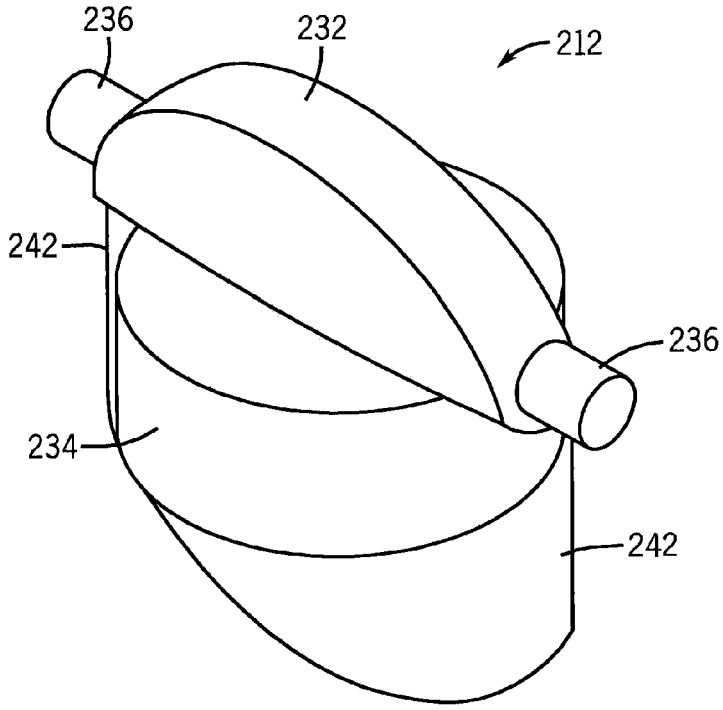
FIG. 8 is a perspective view of an activation device according to another embodiment of the invention.

FIG. 8 illustrates the activation assembly 212, which can include a housing 232 supporting a magnet 234. The housing 232 can include two pins 236 that can be captured within a recess 238 in the first portion 226 (as shown in FIG. 6) of the activation assembly housing 222 against an interior wall of the channel 216. The pins 236 can be integrally formed with the housing 232, as illustrated, or can be separately mounted to the housing 232. The activation assembly 212 can pivot on the pins 236 within the first portion 226 of the activation assembly housing 222. In some embodiments, the housing 232 can be generally disc-shaped, but with truncated sides 242. The truncated sides 242 allow the housing 232 to pivot freely within the first portion 226 of the activation assembly housing 222, which can have a generally cylindrical inner geometry. However, if the inner geometry of the first portion 226 is not circular, for example if it is oval or irregular, the truncated sides 242 still allow the housing 232 to pivot freely. The magnet 234 can be generally disc-shaped and can be situated within a slot 244 in the housing 232, so as to be positioned approximately transverse to the housing 232.

The activation assembly 212 can further include a proximity switch 250 that can be positioned within the pump and motor housing 206 as shown in FIG. 7. As fluid flows through the channel 216, the housing 232 can pivot within the activation assembly housing 222. As the magnet 234 approaches the proximity switch 250 (for example, a reed switch), to close the proximity switch 250, an electrical connection is made which turns on the motor 204. The motor 204 turns on so as to operate the pump 202, pressurizing the fluid flowing through the channel 216.

Figure 9:
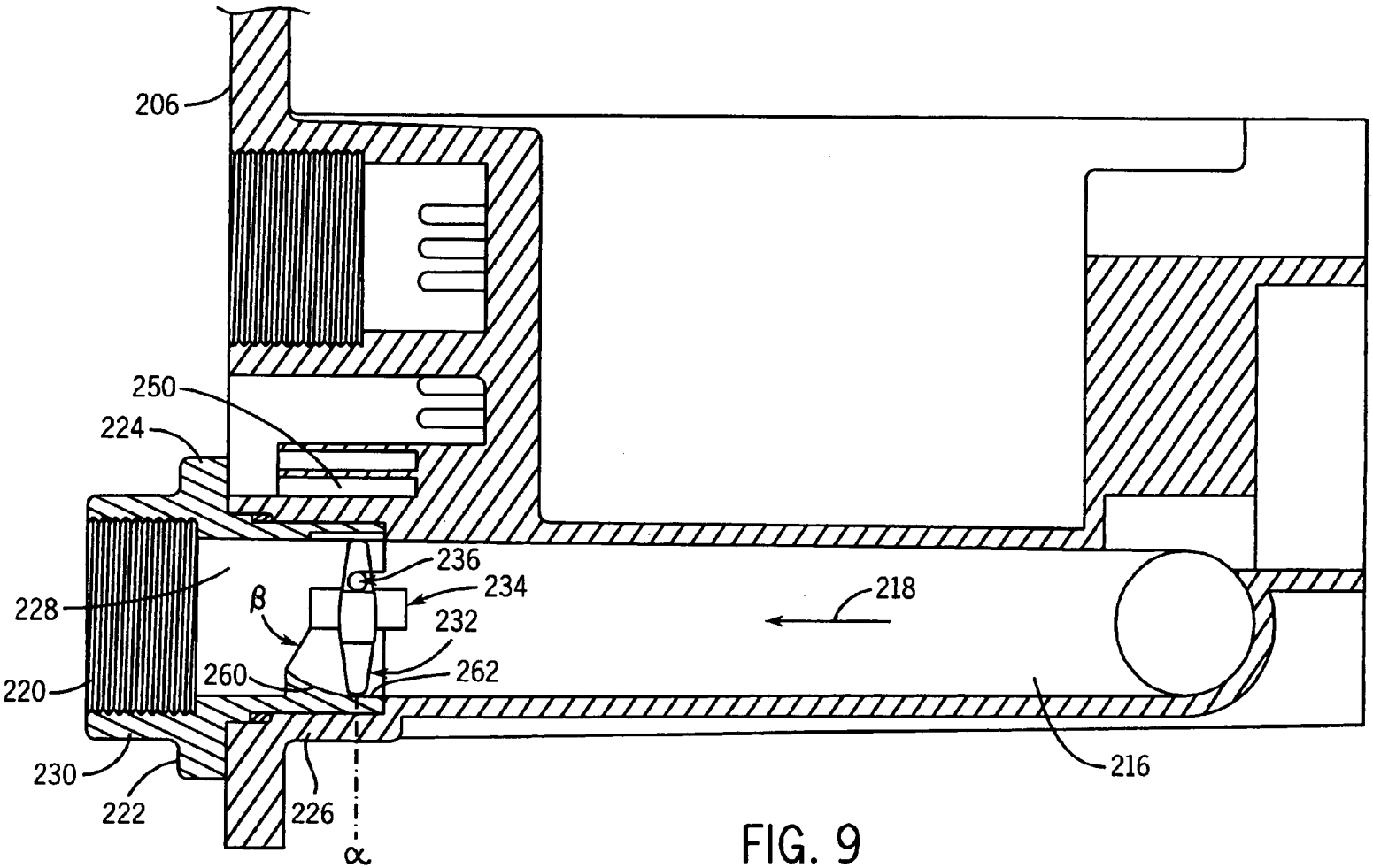
FIG. 9 is a partial cross-sectional view of a portion of the fluid system and activation device of FIG. 5.

As shown in FIG. 9, a curved ledge 260 can be formed on an inner surface 262 of the first portion 226 of the activation assembly housing 222. The curved ledge 260 can be adjacent to the activation assembly 212 and can generally follow the path of the housing 232 as it pivots on the pins 236. The curvature of the ledge 260 in relation to the shape and travel path of the housing 232 can be selected so that substantially no gap exists between curved ledge 260 and the housing 232, as the housing 232 pivots along the curved ledge 260, but also so that the housing 232 pivots freely without snagging or catching on the curved ledge 260. In some embodiments, the curved ledge 260 follows the path of the housing 232 as it travels approximately 30 degrees from a neutral or vertical orientation. In other embodiments, however, the geometry of the curved ledge 260 may be such that the curved ledge 260 follows from about 15 degrees to about 50 degrees of the path of the housing 232.

In some embodiments, the activation assembly housing 222 can be separate from and mounted to the pump and motor housing 206. This arrangement can facilitate manufacture of the pump apparatus 200 and assembly of the activation assembly 212 with the pump apparatus 200. However, in other embodiments, the activation assembly housing 222 is integral to the pump and motor housing 206 so that the housing 232 is pivotably coupled to the channel 216 and the curved ledge 260 is formed on an inner surface of the channel 216.

The housing 232 can be positioned at an initial angle alpha when the valve is closed or the fluid flow rate is zero. Angle alpha can correspond to the position of the activation device 212 in FIG. 9, where the housing 232 is vertically oriented. As the valve is opened, permitting the fluid to flow through the channel 216, fluid flow exerts a force on the housing 232, as indicated by the arrow 218, causing the housing 232 to pivot on the pins 236 toward the proximity switch 250. Although the housing 232 is pivoting away from the angle alpha position, the amount of fluid flowing through the channel 216 past the housing 232 is approximately unchanged, because the curved ledge 260 follows the path of the housing 232. In other words, there is substantially no opening formed between the housing 232 and the interior of the first portion 226 at the curved ledge 260. The amount of fluid flow does not significantly change until the housing 232 pivots beyond the curved ledge 260, which can be at an angle beta of approximately 30 degrees, in one embodiment. However, in some embodiments, the angle beta can be from about 15 degrees to about 50 degrees.

The curved ledge 260 can provide greater control of the flow rate at which the pump 202 is activated. As the valve is opened and fluid flows through the channel 216, substantially no fluid is allowed beyond the housing 232 until the housing 232 has pivoted beyond the angle beta. However, once the fluid flow is sufficient to pivot the housing 232 beyond the angle beta, only a small increase in additional fluid flow is needed to pivot the housing 232 to a position sufficiently close to the proximity switch 250 to activate the proximity switch 250 and turn the motor 204 on. This can reduce the necessary flow rate through the channel 216 at which the motor 204 is turned on to drive the pump 202. In other words, the pump 202 is engaged to pressurize fluid flowing through the channel 216 at a lower fluid flow rate. As a result, the pump apparatus 200 can be used in conjunction with flow delivery systems in which the fluid flow rate at which the pump apparatus 200 is desired to be engaged is relatively low. While a variety of factors can be adjusted to select the pump turn-on flow rate (e.g., the strength of the magnet 234 and/or the distance between the housing 232 and the proximity switch 250), the curved ledge 260 can provide a mechanism for reducing the pump turn-on flow rate without using a stronger magnet or a more sensitive proximity switch.

The curved ledge 260 can also provide a more robust pump apparatus 200 after installation. The pump apparatus 200 can be installed on, for example, an unleveled or uneven wall or floor, without substantially affecting the fluid flow rate at which the motor 204 is turned on.

Thus, the invention provides, among other things, a fluid delivery system which increases fluid pressure through the fluid delivery system in response to the flow of fluid through the fluid delivery system. Various features and advantages of the invention are set forth in the following claims.

The invention claimed is:

1. A pump apparatus comprising:

a pump that increases pressure of fluid in communication with the pump apparatus, the pump including a channel through which fluid flows from the pump;

a motor that operates the pump;

an activation assembly housing forming at least a portion of said channel; and an activation assembly positioned in the activation assembly housing, the activation assembly being movable to and from an activation position at which the motor and the pump are activated in response to a flow rate of fluid in communication with the pump apparatus, the activation assembly including a magnet housing with an integrated magnet positioned in the channel and at least one pin positioned in the channel, the at least one pin being in contact with the activation assembly housing to support the activation assembly entirely within the channel, the activation assembly pivoting about the at least one pin within the channel to move from a first position substantially perpendicular to a direction of fluid flow through the channel toward a second position substantially parallel to the direction of fluid flow through the channel, the activation position being between the first position and the second position, the activation assembly housing including an inner surface with a curved ledge extending along at least a portion of a path traveled by the activation assembly, the curved ledge preventing fluid from flowing through the channel until the activation assembly has pivoted to the activation position past the curved ledge and at least 30 degrees about the at least one pin.

2. The pump apparatus of claim 1, wherein the pump apparatus further comprises a proximity switch that closes to turn on the motor and the pump when the activation assembly is in the activation position.

3. The pump apparatus of claim 2, wherein the proximity switch operates with a current of 0.1 milliamp to ten milliamps.

4. The pump apparatus of claim 2, wherein the proximity switch is a reed switch.

5. The pump apparatus of claim 2, wherein:

the magnet creates a magnetic field; and the magnetic field causes the proximity switch to close to allow current flow to the motor when the activation assembly is in the activation position.

6. The pump apparatus of claim 5, wherein:

the motor comprises a motor switch; and the motor switch turns on the motor and the pump when the proximity switch is closed and the activation assembly is in the activation position.

7. The pump apparatus of claim 6, wherein a first current required to close the proximity switch is less than a second current required to activate the motor switch.

8. The pump apparatus of claim 6, wherein the motor switch operates with a current of 0.1 amps to fifty amps.

9. The pump apparatus of claim 6, wherein the motor switch is a relay.

10. The pump apparatus of claim 1, wherein the magnet housing allows transmission of magnetic waves.

11. The pump apparatus of claim 10, wherein the magnet housing comprises a polymeric material.

12. The pump apparatus of claim 1, wherein the activation assembly is moved to the activation position when a flow rate of fluid contacting the activation assembly is greater than one liter per minute.

13. The pump apparatus of claim 1, wherein the pump comprises a pump and motor housing and the activation assembly is inside the pump and motor housing.

14. The pump apparatus of claim 1, wherein the horsepower of the motor ranges from 0.05 hp to ten hp.

* * * * *